United States Patent [19]

Fujiki et al.

[11] 4,443,993

[45] Apr. 24, 1984

[54] METHOD OF HEAT-INSULATING AND WATER-PROOF CONSTRUCTION

[75] Inventors: Toshiaki Fujiki; Hikaru Kano, both of Hyogo, Japan

[73] Assignee: Mitsuboshi Belting Ltd., Hyogo, Japan

[21] Appl. No.: 321,012

[22] Filed: Nov. 13, 1981

[51] Int. Cl.[3] ..... E04D 3/35

[52] U.S. Cl. ..... 52/746; 156/71; 52/309.4; 52/520; 52/543

[58] Field of Search ..... 52/478, 479, 404, 529, 52/537, 528, 276, 746, 520, 527, 543, 747, 748, 52/309.4, 309.8, 478, 506, 552; 156/71, 92, 212, 216

[56] References Cited

U.S. PATENT DOCUMENTS

| | | | |
|---|---|---|---|
| 2,049,278 | 7/1936 | Toussaint et al. | 52/276 |
| 3,121,649 | 2/1964 | Oliver | 52/421 |
| 3,158,960 | 12/1964 | Newton et al. | 52/529 |
| 3,422,589 | 1/1969 | Harrison | 52/528 |
| 3,909,998 | 10/1975 | Simpson et al. | 52/537 |
| 3,961,454 | 6/1976 | Adams | 52/404 |

FOREIGN PATENT DOCUMENTS

| | | | |
|---|---|---|---|
| 2142672 | 3/1972 | Fed. Rep. of Germany | 52/479 |

*Primary Examiner*—James L. Ridgill, Jr.
*Attorney, Agent, or Firm*—Sughrue, Mion, Zinn, Macpeak & Seas

[57] ABSTRACT

A method of constructing a heat-insulating and water-proof structure by employing a plurality of heat-insulating members and a plurality of water-proof membranes. A first water-proof membrane is placed over a heat-insulating member, and one longitudinal edge of the water-proof membrane is bent about one longitudinal edge of the first heat-insulating member and secured to a base surface. A second heat-insulating member is then laid on the base surface next to the first heat insulating member so that the one longitudinal edge of the first water-proof membrane is held between the first and second heat-insulating members. A second water-proof membrane is placed over the second member and one longitudinal edge thereof is bent and secured to the base surface. The other longitudinal edge of the second water-proof membrane is joined to the first water-proof membrane. This sequence of work is repeated until a predetermined number of heat-insulating members are laid on the base surface, and a corresponding number of water-proof membranes are applied to the heat-insulating members.

13 Claims, 5 Drawing Figures

METHOD OF HEAT-INSULATING AND WATER-PROOF CONSTRUCTION

BACKGROUND OF THE INVENTION

1. Field of the Invention

This invention relates to a method of constructing a heat-insulating and water-proof structure. More particularly, it is concerned with a method of constructing a heat-insulating and water-proof structure by laying, but not securing a plurality of heat-insulating boards on a base surface, and by joining a plurality of water-proof membranes joined to one another so that each membrane covers one of the heat-insulating boards.

2. Description of the Prior Art

A lot of insulating and water-proof structures have been developed since lightweight roofing slabs became available. For example, it is well known to attach heat-insulating materials, in the form of foamed polyethylene or polyurethane membranes, to roofing slabs with an adhesive, and securing a large water-proof membrane to the insulating material with an adhesive. The adhesive is employed on both sides of the heat-insulating material. This method involves a number of drawbacks which cannot be avoided unless a high level of skill is employed in construction work. The water-proof membrane wrinkles and swells easily when using the adhesive. In addition, specks of the adhesive formed when it is applied or dries makes it difficult for the water-proof membrane to adhere uniformly to the heat-insulating material.

In order to improve these drawbacks, there has been developed a fastening method which does not employ any adhesive. According to this method, a water-proof sheet is secured to a heat-insulating material by fastening means such as screws, nails, rubber members or holding bars. The heat-insulating material is secured to a roof deck, and the fastening means are covered with rubber strips or membranes. Although this method has overcome the drawbacks which are caused by the adhesive, it still has a number of other drawbacks. Those portions of the water-proof membrane which are secured by the fastening means to the heat-insulating material are likely to be pulled away from the heat-insulating material by wind pressure or other external forces. As a result, these forces in conjuction with the fastening means subject the water-proof member to height stresses and the water-proof membrane is easily torn by the fastening means which secure it to the heat-insulating material. Moreover, the fastening means, and the rubber strips or membranes covering them, protrude from the water-proof sheet and impair the appearance of the structure. Furthermore, it is impossible to remove any wrinkle that has formed in the water-proof membrane.

SUMMARY OF THE INVENTION

It is an object of this invention to provide a novel and improved method of constructing a heat-insulating and water-proof structure which eliminates the aforesaid drawbacks of the prior art. The method of this invention is intended for firmly securing water-proof membranes covering heat-insulating materials, improving the appearance of the water-proof membranes in the areas where they are secured, preventing formation of any crease in the water-proof membranes, and providing the water-proof membranes with a smooth surface finish which presents a fine appearance.

According to this invention, there is provided a method of heat-insulating and water-proof construction which comprises the steps of placing a plurality of heat-insulating members one by one on a base surface, placing a plurality of water-proof membranes one by one on the heat-insulating members so that each water-proof membranes may cover at least one heat-insulating member and have one longitudinal edge terminating between an adjoining heat-insulating member and the base surface, the heat-insulating members being free from the base surface, and the water-proof membranes being free from the heat-insulating members, securing the one longitudinal edge of each water-proof membrane to the base surface, and joining the other longitudinal edge of each water-proof membrane to an adjoining water-proof membrane so that all of the water-proof membranes may be joined to one another.

DESCRIPTION OF THE PREFERRED EMBODIMENTS

Figure 1:
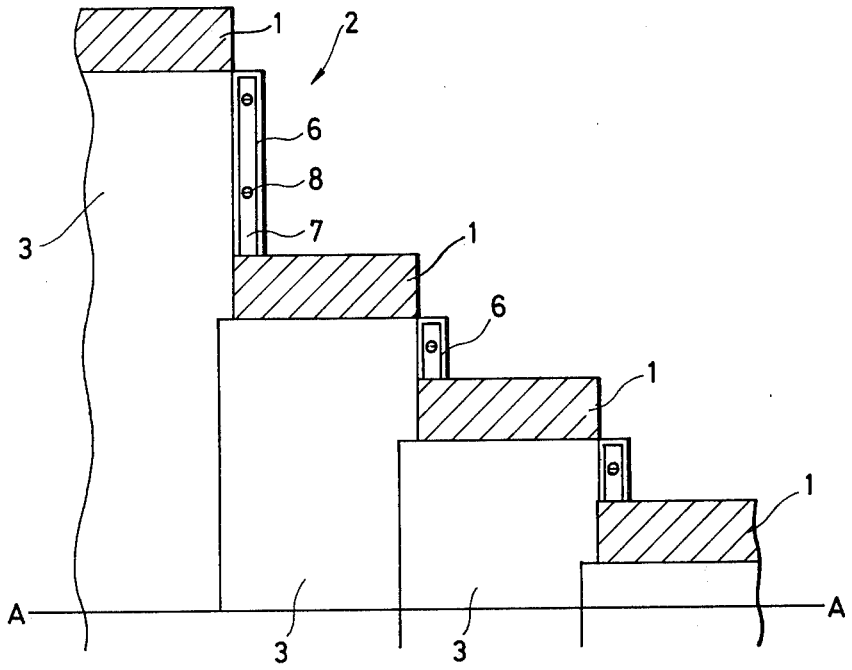
FIG. 1 is a fragmentary top plan view of a heat-insulating and water-proof structure constructed by a method embodying this invention.
Figure 2:
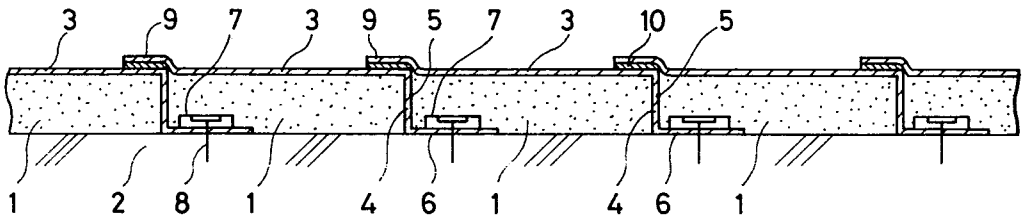
FIG. 2 is a sectional view taken along line 2—2 of FIG. 1.

Referring first to FIGS. 1 and 2 of the drawings, there is fragmentarily shown a heat-insulating and water-proof structure constructed by a method embodying this invention. A heat-insulating member 1 is laid on a horizontal or inclined base surface 2. The heat-insulating member 1 comprises a membrane of foamed polystyrene, polyethylene or polyurethane, a fiber board, or a composite thereof having a width of 900 to 2,400 mm and a thickness of 12 to 80 mm. The heat-insulating member 1 is not joined to the base surface 2. A water-proof membrane 3 is placed on the heat-insulating member 1 and not joined thereto. The water-proof membrane 3 comprises, for example, a vulcanized sheet of rubber, such as ethylene-propylene terpolymer, butyl rubber, or a mixture thereof. One longitudinal edge portion 4 of the water-proof membrane 3 is bent along one side 5 of the heat-insulating member 1, but not joined thereto. The longitudinal edge portion 4 has a width of at least 50 mm. It is bent again in an L-shaped pattern as shown at reference numeral 6, and secured to the base surface 2. If the base surface 2 is composed of concrete, the water-proof membrane 3 is secured thereto with an adhesive. If it is made of wood or steel, the water-proof membrane 3 can be secured thereto quickly and rigidly if fastening members 8, such as screws or nails, are employed. In this case, an auxiliary fastening member 7 is applied to the longitudinal edge 6 of the water-proof membrane 3. The auxiliary fastening member 7 may comprise a holding bar or batten of a metal or resin, or a strip of rubber.

A second heat-insulating member 1, which is equal in thickness to the first heat-insulating member 1, is placed on the base surface 2, so that it may cover the longitudinal edge 6 of the first water-proof membrane 3. The longitudinal edge portion 4 of the first water-proof membrane 3 is thus held between the two heat-insulating members 1. A second water-proof membrane 3 is placed on the second heat-insulating member 1, and one longitudinal edge portion 4 thereof is bent along one side 5 of the second heat-insulating member 1, and secured to the base surface 2 by another auxiliary fastening member 7 and fastening member 8, exactly in the same manner as herein above described. This sequence of work is repeated until a predetermined number of heat-insulating members 1 are laid on the base surface 2, and a corresponding number of water-proof membranes 3 are placed thereon, and secured to the base surface 2.

The other longitudinal edge 9 of each water-proof membrane 3, which may have a width of 50 to 100 mm, is joined to an adjoining water-proof membrane 3 with an adhesive tape 10 of, for example, the self curing curable type. Thus, the water-proof sheets divide the heat-insulating members from one another, and are joined to one another on the heat-insulating members. This arrangement eliminates the necessity of joining the heat-insulated members to the base surface and the water-proof membranes with an adhesive, and yet ensures that the heat-insulating members are firmly held by the water-proof membranes, since one longitudinal edge of each water-proof membrane is firmly secured by the fastening members, while the other longitudinal edge of each water-proof membrane is joined to the adjoining water-proof membrane.

The foregoing description is an embodiment in which each water-proof membrane covers one heat-insulating member. This invention is, however, not limited to such an arrangement and is also applicable to other cases in which each water-proof membrane covers two or more heat-insulating members.

Figure 3:
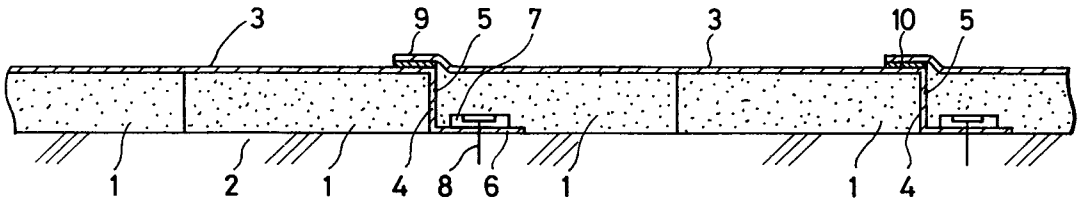
FIG. 3 is a view similar to FIG. 2, but showing a modified form of construction according to the method of this invention.

Referring, therefore, to FIG. 3, there is shown a modified arrangement in which each water-proof membrane covers two heat-insulating members. Two heat-insulating members 1 are placed longitudinally close to each other, and covered by a water-proof membrane 3 having a width which is sufficient to cover the combined width of the two heat-insulating members. One longitudinal edge 6 of each water-proof membrane 3 is secured to the base surface 2 by an auxiliary fastening member 7 and a fastening member 8, while the other longitudinal edge 9 thereof is joined to an adjoining water-proof membrane 3, as hereinbefore described. The arrangement of FIG. 3 reduces the number of the water-proof membranes which are required, and therefore, the time and labor required for securing and joining the longitudinal edges of the water-proof membranes. This means a reduction in the time required for construction.

Figure 4:
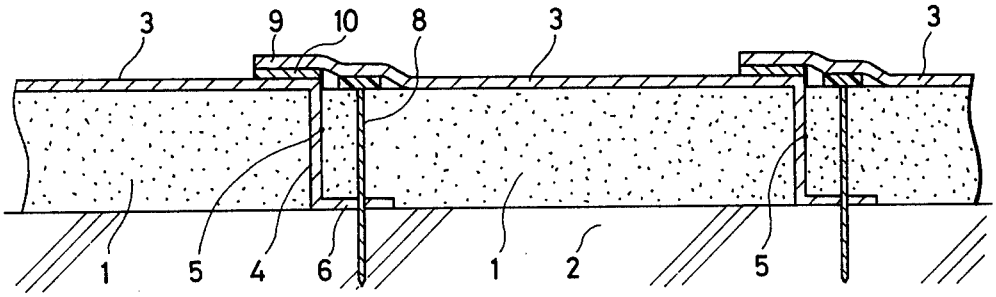
FIG. 4 is a view similar to FIG. 2, but showing a still different form of construction according to the method of this invention.

Referring now to FIG. 4, there is shown a still different form of construction. A heat-insulating member 1 is laid on the base surface 2, but not joined thereto. A water-proof membrane 3 is placed on the heat-insulating member 1, but not joined thereto. One longitudinal edge portion 4 of the water-proof membrane 3 is bent along one side 5 of the heat-insulating member 1, and not joined thereto, but is bent again in an L-shaped pattern as shown at 6. The longitudinal edge 6 is not secured to the base surface 2. A second heat-insulating member 1 is laid on the base surface 2 and the longitudinal edge 6 of the first water-proof membrane 3, whereby the longitudinal edge portion 4 of the water-proof membrane 3 is held between the two heat-insulating members 1. Fastening members 8, such as nails or screws, are driven through the second heat-insulating member 1 adjacent to an edge thereof, and through the longitudinal edge 6 of the first water-proof membrane 3 to secure the second heat-insulating member 1 and the first water-proof sheet 3 to the base surface 2. This sequence of work is repeated until a predetermined number of heat-insulating members are laid, and a corresponding number of water-proof membranes are applied thereto. Then, the other longitudinal edge 9 of each water-proof membrane 3 is joined to an adjoining membrane 3 by an adhesive tape 10, whereby all the water-proof membranes 3 are joined to one another, as hereinbefore described.

Figure 5:
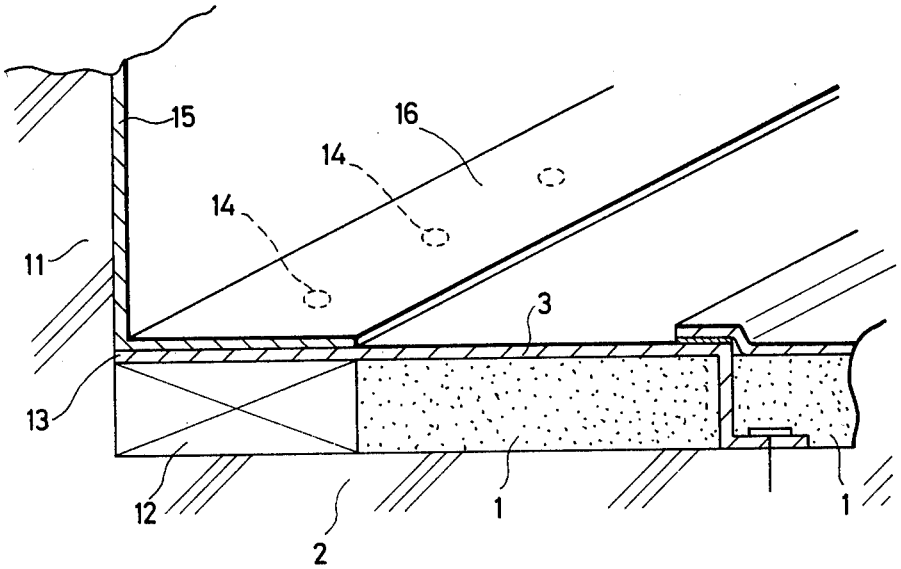
FIG. 5 is a fragmentary perspective view showing an edge of the structure constructed by the method of this invention.

Attention is now directed to FIG. 5 showing a mode of construction at an edge of a structure constructed according to the method of this invention. More specifically, FIG. 5 shows an arrangement involving an upright wall 11 which is perpendicular to a base surface 2. A wooden auxiliary member 12 is placed in contact with the upright wall 11, and a first heat-insulating member 1 is laid in contact with the wooden member 12. A water-proof sheet 3 is placed on the wooden member 12 and the heat-insulating member 1. One longitudinal edge 13 of the water-proof sheet 3 is bent and secured to the base surface 2 as hereinbefore described. The other longitudinal edge of the water-proof sheet 3 is placed in contact with the upright wall 11. Fastening members 14, such as screws or nails, are driven through the water-proof sheet 3 and the wooden member 12 to secure the water-proof sheet 3 to the wooden member 12. Then, a water-proof sheet 15 is secured to the upright wall 11, and its lower edge portion 16 is bent horizontally, and joined to the water-proof membrane 3 on the wooden member 12 with an adhesive or adhesive tape. A similar mode of work may be employed for finishing construction at the opposite edge of the base surface.

According to the method of this invention, the heat-insulating members are not joined to the base surface or to the water-proof membranes with an adhesive. Rather, one longitudinal edge of each water-proof membrane is secured to the base surface, while the other longitudinal edge thereof is joined to an adjoining water-proof membrane, as hereinabove described in detail. The water-proof membranes covering the heat-insulating members are secured firmly. Since no nails or other fastening members are used for securing the water-proof membranes directly to the heat-insulating members, the water-proof membranes can be protected against damage in the areas where they are secured, and the water-proof membranes provide a smooth surface and a fine appearance to a heat-insulating and water-proof structure. As the structure is composed of a plurality of heat-insulating members divided from one another by water-proof membranes, it is possible to use water-proof membranes having a relatively small width, and therefore prevent formation of wrinkles in the water-proof membranes. Since each heat-insulating member, or each group of heat-insulating members is sealed by a water-proof membrane, it is possible to prevent any water from migrating from one heat-insulating member to another, or from one group of heat-insulating members to another.

What is claimed is:

1. A method of constructing a heat insulating and waterproof structure by employing a plurality of heat insulating members and a plurality of waterproof membranes, comprising the steps of:

laying a first heat insulating member on a base surface, said member being composed of at least one heat insulating material;

placing a first waterproof membrane on said first heat insulating member;

bending one longitudinal edge of said first waterproof membrane about one longitudinal edge of said first heat insulating member;

securing a first part of said one longitudinal edge of said waterproof membrane to said base surface;

laying a second heat insulating member on said base surface and said first part of said one longitudinal edge of said first waterproof membrane 3 adjacent to and in contact with a second part of said one longitudinal edge of said waterproof membrane which is adjacent to said first part, said second part being held between said first and second heat-insulating members;

placing a second waterproof membrane on said second heat insulating member;

bending one longitudinal edge of said second waterproof membrane about one longitudinal edge of said second heat insulating member;

securing a first part of said one longitudinal edge of said second waterproof membrane to said base surface; and joining the other longitudinal edge of said second waterproof membrane to said first waterproof membrane.

2. The method as set forth in claim 1, further comprising the steps of:

placing respective first and second auxiliary fastening members on said first part of said one longitudinal edge of said first and second waterproof membranes, respectively; and passing first and second fastening members through said respective auxiliary fastening members and said respective first part of said one longitudinal edge of said first and second waterproof membranes to secure the first and second waterproof membranes to said base surface.

3. The method as set forth in claim 2, wherein said auxiliary fastening members each comprise a strip having a maximum width which is substantially equal to a width of said first part of said one longitudinal edge of each of said first and second waterproof membranes across which each of said waterproof membranes is secured to said base surface.

4. The method as set forth in claim 1 further comprising the steps of:

passing a fastening member 8 through said second heat insulating member and through said first part of said one longitudinal edge of said first waterproof membrane into said base surface.

5. The method as set forth in claim 1, wherein each of said first and second heat-insulating members comprises two heat-insulating members.

6. The method as set forth in claim 1, wherein each of said heat-insulating members is selected from the group consisting of a foamed synthetic resin sheet, a fiber board, perlite, and a composite thereof.

7. The method as set forth in claim 1, wherein said water-proof membranes each comprise a vulcanized sheet of rubber selected from the group consisting of ethylene-propylene terpolymer, butyl rubber, and a mixture thereof.

8. The method as set forth in claim 7, wherein said second water-proof membrane is joined to said first water-proof membrane with an unvulcanized tape of rubber which is self curing vulcanizable.

9. The method as set forth in claim 1 wherein a width of each of said heat-insulating members is between 900 and 2400 mm and a thickness thereof is between 12 and 80 mm.

10. The method as set forth in claim 1 wherein a width of said one longitudinal edge of said first and second water-proof membranes is at least 50 mm.

11. The method as set forth in claim 1 wherein said one longitudinal edge of said first and second water-proof membranes has an L-shaped pattern.

12. The method as set forth in claim 1, further comprising the step of:

placing an auxiliary member next to a wall, one side of said auxiliary member being in contact with said wall, the other side of said auxiliary member being in contact with said first heat-insulating member, said first water-proof membrane covering said auxiliary member as well as said first heat-insulating member and having an edge being in contact with said wall;

passing a fastening member through said first water-proof membrane and into said auxiliary member;

placing a third water-proof membrane next to said wall;

bending a lower edge of said third water-proof membrane; and joining said lower edge of said third water-proof membrane to said first water-proof membrane.

13. The method as set forth in claim 12 wherein said auxiliary member is made of wood.

* * * * *